US006560786B2

(12) United States Patent
Lipton

(10) Patent No.: US 6,560,786 B2
(45) Date of Patent: May 13, 2003

(54) QUICK RELEASE AND REFASTENABLE UNDERGARMENT

(76) Inventor: Jody C. Lipton, 5709 Faraday Ave. Apt.#1, Bronx, NY (US) 10471

( * ) Notice: Subject to any disclaimer, the term of this patent is extended or adjusted under 35 U.S.C. 154(b) by 0 days.

(21) Appl. No.: 09/991,359

(22) Filed: Nov. 19, 2001

(65) Prior Publication Data

US 2002/0078493 A1 Jun. 27, 2002

Related U.S. Application Data

(60) Provisional application No. 60/258,219, filed on Dec. 26, 2000.

(51) Int. Cl.[7] ..... A41B 9/00

(52) U.S. Cl. ..... 2/400; 2/406; 2/67

(58) Field of Search ..... 2/400, 403, 406, 2/408, 67, 83, 80, 227, 228, 238; 450/100, 106, 107, 108, 119, 129, 134, 136, 137, 138, 140, 141; 604/385.1–399

(56) References Cited

U.S. PATENT DOCUMENTS

| | | | | | |
|---|---|---|---|---|---|
| 2,085,425 | A | * | 6/1937 | Goodwin | 2/400 |
| 2,408,723 | A | * | 10/1946 | Arpin et al. | 2/400 |
| 2,500,255 | A | | 3/1950 | Lee | |
| 3,094,990 | A | | 6/1963 | Neilson | |
| 3,243,824 | A | * | 4/1966 | Overholt | 2/406 |
| 4,028,740 | A | * | 6/1977 | Luerken | 2/67 |
| 4,229,835 | A | * | 10/1980 | Shaw | 2/406 |
| 4,414,691 | A | * | 11/1983 | Estruch | 2/67 |
| 4,597,110 | A | | 7/1986 | Smith, Sr. et al. | |
| 4,615,051 | A | * | 10/1986 | Hashimoto | 2/406 |
| 4,698,855 | A | * | 10/1987 | Hicks | 2/402 |
| 4,937,887 | A | * | 7/1990 | Schreiner | 2/402 |
| 5,347,657 | A | * | 9/1994 | Unsell | 2/67 |
| 5,423,789 | A | | 6/1995 | Kuen | |
| 5,535,452 | A | | 7/1996 | Rozenblat | |
| 5,551,093 | A | * | 9/1996 | Stricker | 2/406 |
| 5,704,933 | A | | 1/1998 | Fell et al. | |
| 5,903,922 | A | | 5/1999 | Vargason | |
| 6,092,242 | A | | 7/2000 | Niedermeyer | |
| 6,247,184 | B1 | * | 6/2001 | Watts | 2/400 |

OTHER PUBLICATIONS

Gershman, M.D., Maurice; Journal of American Medical Assn., vol. 68–No. 7. "Self–Adhering Nylon Tapes". Oct. 18, 1958.*

* cited by examiner

*Primary Examiner*—Gloria M. Hale
(74) *Attorney, Agent, or Firm*—Ostrolenk, Faber, Gerb & Soffen, LLP

(57) ABSTRACT

An undergarment with a front and rear panel and a crotch panel joining them, wherein the panels are so shaped that at the waistband, at the side of the wearer's body, the front and rear panels are spaced apart. A flexible strap attached to the top edge of each side of the rear panel extends to the front panel. Respective fastening devices on the end of the strap and on the front panel at the waistband enable separable attachment to complete the undergarment. The fastening devices are selected from a group consisting of hook and loop fasteners, snap fasteners, belt and buckle fasteners, hook and eye fasteners, clasp fasteners, bow and tie fasteners and slide fasteners.

13 Claims, 7 Drawing Sheets

QUICK RELEASE AND REFASTENABLE UNDERGARMENT

CROSS REFERENCE TO RELATED APPLICATION

This application is based upon and claims priority from U.S. provisional application No. 60/258,219 entitled "QUICK RELEASE AND REFASTENABLE UNDERGARMENT", filed Dec. 26, 2000.

BACKGROUND OF THE INVENTION

The present invention relates to undergarments and particularly to underpants-type undergarments. More particularly, the present invention provides a quick release and refastenable undergarment having detachable and refastenable right and left side, usually at a height between the waist and the hip waistband fastener devices located at the front ends of right and left side waistband straps which are fastenable at mating right and left fastener devices affixed to the upper right and left corner regions of a front panel of the garment.

The prior art illustrates various types of undergarments and diapers with reopenable fastenings. U.S. Pat. No. 4,597,110 discloses panties having a single crotch opening provided with a first and second VELCRO® fastener. U.S. Pat. No. 5,535,452 discloses a man's removable undergarment having a frontal opening closeable with hook and eye fasteners. U.S. Pat. No. 5,903,922 discloses a removable undergarment attached preferably with a hook and loop fastener. U.S. Pat. No. 6,092,242 discloses an undergarment assembly comprised of two shaped half width segments held together by a releasable fastener joining two overlapping front panel half width segments. Securing the front and rear panels of a diaper or undergarment directly to each other and without a waistband providing the connection is shown in U.S. Pat. No. 2,500,255. U.S. Pat. No. 3,094,990 discloses suspenders from a waistband which are connected to the front and rear undergarment panels. Fully detached straps located at the waist and not permanently attached to either of the front or the rear the diaper panels at either end of the straps, are shown in U.S. Pat. Nos. 5,423,789 and 5,704,933.

SUMMARY OF THE INVENTION

The present invention concerns an undergarment with a front panel extending in front of a wearer's body and a rear panel extending over the rear of the body and the garment passing under the crotch to join the front and rear panels. At least one panel may define the front and rear panels and the part joining them at the crotch. The front and rear may be separate panels joined and there may be a crotch panel joining the front and rear panels.

The present invention particularly concerns fastener devices between the front and rear panels located at the upper edges at the corners of the panels, at the waistband of the garment, which is generally between the wearer's waist and hips depending on the style and height of the particular garment and the wearer's body shape. A strap affixed to each of the left and right upper corner regions of the rear panel extends forward to the front panel to which each strap is separately fastened at the respective left and right upper corner regions of the front panel.

Any type of mating-pair compatible fastener devices may be used, including button and loop fastener devices (FIGS. 1–7), hook and mating loop VELCRO® or VELCRO®-type fastener devices (FIG. 7A), snap fastener devices (FIG. 7B), belt and buckle fastener devices (FIG. 7C), hook and eye fastener devices (FIG. 7D), interlocking clasp fastener devices (FIG. 7E), tie fastener devices (FIG. 7F), and slide fastener devices (FIG. 7G). The mating-pair compatible fastener devices facilitate connection of the waistband fastener devices to the front panel fastener and enable quick release disconnection. Connection and disconnection may be performed individually on the right side or left side of the front panel, or on both sides, sequentially or simultaneously.

BRIEF DESCRIPTION OF THE DRAWINGS

Other objects and features of the present invention are illustrated in the accompanying drawings, wherein:

FIGS. 7A–G show alternative waistband fastener devices and respective mating front panel fastener devices wherein;

FIG. 7A shows a loop and hook, Velcro or Velcro-type fastener device,

FIG. 7B shows a snap fastener device,

FIG. 7C shows a belt and buckle fastening device,

FIG. 7D shows a hook and eye fastener device,

FIG. 7E shows an interlocking clasp fastener device,

FIG. 7F shows a tie fastener device; and

FIG. 7G shows a slide fastener device.

DESCRIPTION OF PREFERRED EMBODIMENTS

Figure 1:
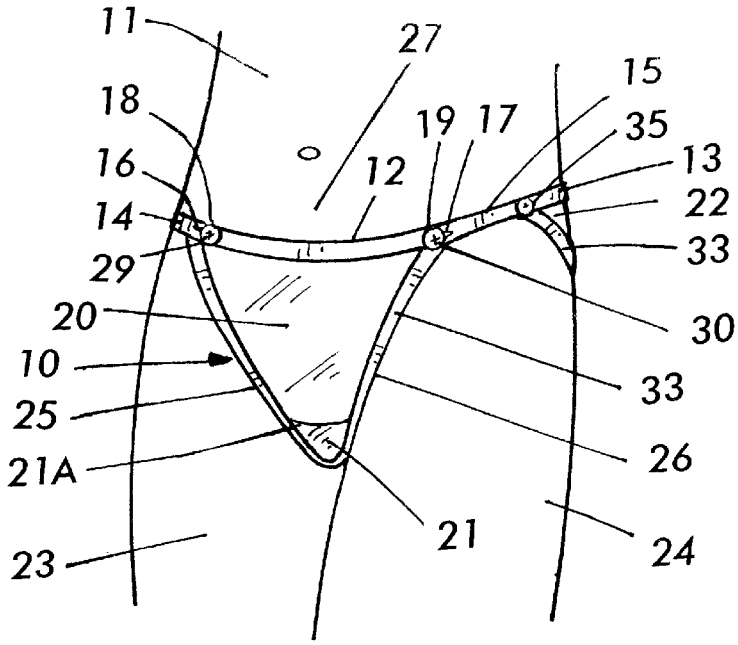
FIG. 1 is a left-front, three-quarter view illustrating one presently preferred form of a quick release and refastenable undergarment according to the present invention worn in its fastened state.
Figure 2:
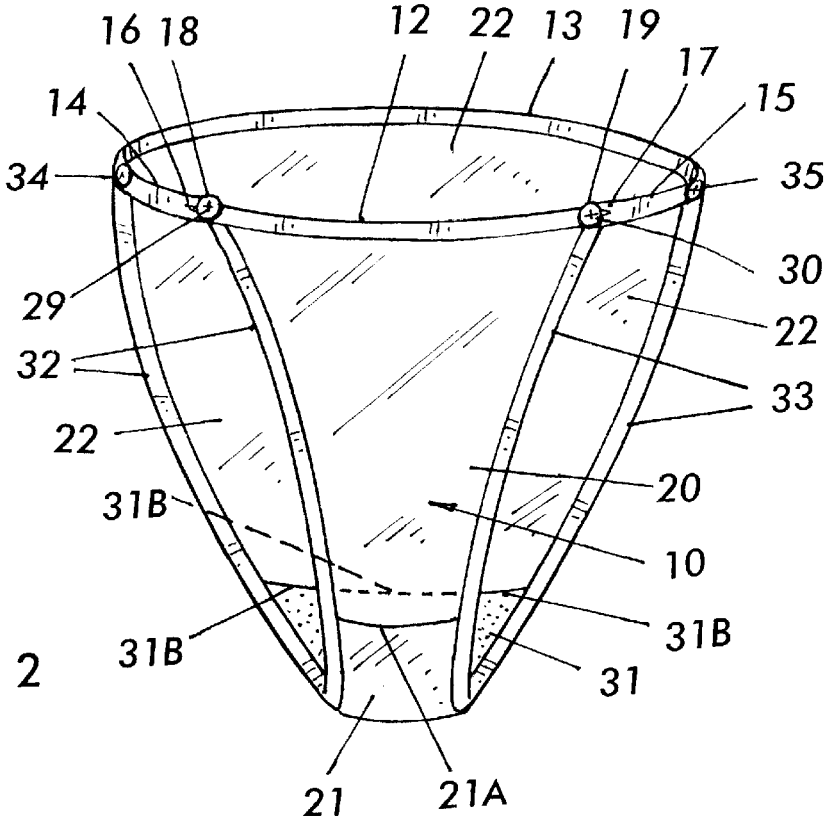
FIG. 2 is a front view of the undergarment of FIG. 1 in its fastened state.
Figure 3:
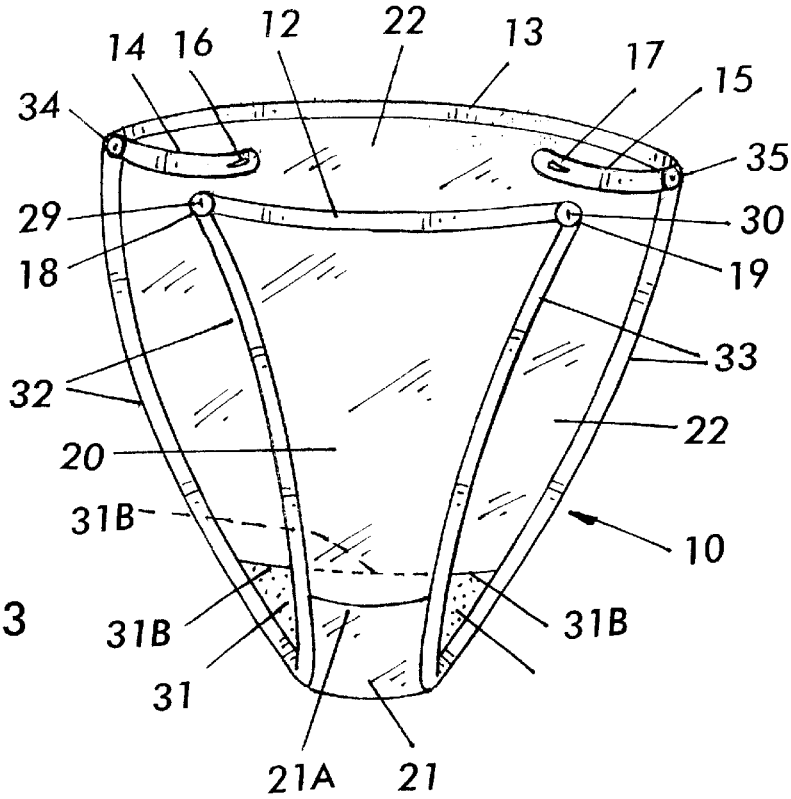
FIG. 3 shows that undergarment with disconnected fastener devices.
Figure 4:
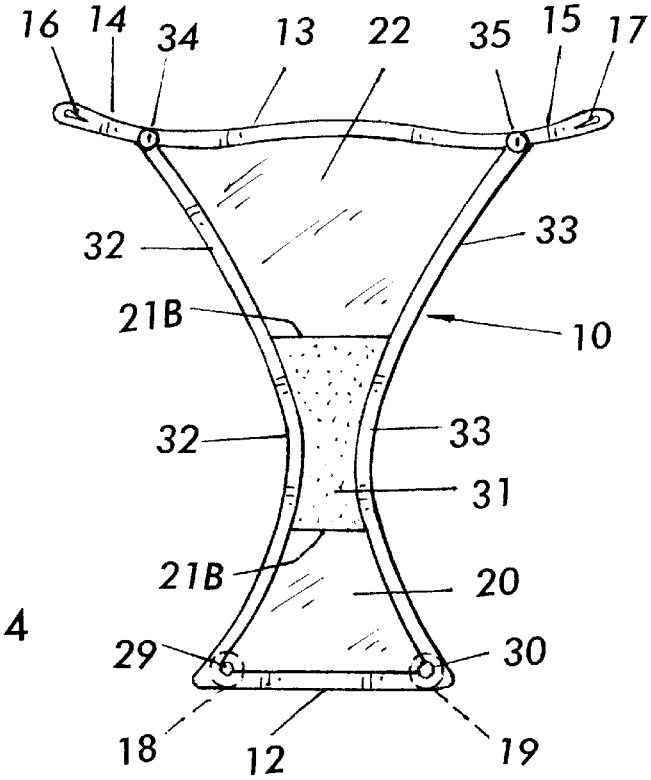
FIG. 4 is an inside or plan view of the undergarment in a fully extended open state.

FIGS. 1–4 show an example of an undergarment 10 which maybe used with any of the embodiments of the fastener devices of the invention. The undergarment shown is comprised of three separate panels permanently attached to define one garment, namely the front panel 20, the crotch panel 21, and the rear panel 22. They may be alternatively manufactured as a single panel to form the garment. FIGS. 2 and 4 also show the attachment of the crotch panel 21 to the front panel 20 outside seam 21A and attachment of a crotch panel liner 31 to the front panel 20 inside seam 21B and to the rear panel 22 inside seam 31B.

In the following description, the waistband of the garment is discussed. That is a typically elastic band at the top edge of the undergarment. Depending on the nature of the undergarment, from taller brief to shorter bikini style, the height of the waistband along the wearer's body may not be at the waist, but may be anywhere from near the waist down to the hips.

The undergarment front panel 20 has a waistband 12, which runs along the full length of and along the top of the front panel 20. The crotch panel 21 is attached to the front panel 20 at an outside seam 21A. The rear panel 22 has a waistband 13, which runs along the full length of and along the top of the rear panel 22. The waistbands 12 and 13 are preferably elastic.

The garment has a right leg band 32 which runs along the full length of the right side of the rear panel 22, the full length of the right side of the crotch panel 21, and the full length of the right side of the front panel 20 for encircling the wearer's right leg 23 and creating a right leg opening 25. Likewise, the garment has a left leg band 33 that runs along the full length of the left side of the rear panel 22, the full length of the left side of the crotch panel 21, and the full length of the left side of the front panel 20 for encircling a wearer's left leg 24 and creating a left leg opening 26. The leg bands 32 and 33 are preferably elastic.

The panels 20 and 22 are of such size that their upper corners, which are typically at the waistband, are normally spaced apart along both sides of the wearer's body between the waist and the hips. The gaps between the panels at the waistband are bridged by the straps 14 and 15.

FIG. 1 shows first embodiment of undergarment 10 in its closed fastened state. It includes the left side waistband strap 15 and the left side waistband strap fastener device 17 detachably attached to a mating front panel left fastener device 19 and includes the right side waistband strap 14 and the right side waistband strap fastener device 16 detachably attached to the mating front panel right fastener device 18. The straps 14 and 15 are preferably elastic. Each of waistband fastener devices 16 and 17 and the mating front panel right fastener devices 18 and 19 are representative mating pairs of any design of compatible fastener devices, shown here as buttons 18 and 19 and respective loops 16 and 17 which are secured on the buttons. The present invention incorporates any design of mating-pair compatible fastener devices, including, loop and hook VELCRO® or VELCRO®-type fastener devices (FIG. 7A), snap fastener devices (FIG. 7B), belt and buckle fastener devices (FIG. 7C), hook and eye fastener devices (FIG. 7D), interlocking clasp fastener devices (FIG. 7E), tie fastener devices (FIG. 7F), and slide fastener devices (FIG. 7G), or others.

There is an attachment point 35 for the rear of the left side waistband strap 15 and the left side of the rear panel waistband 13 at the intersection with the top of the left leg band 33, at the upper left corner of the rear panel 22. There is also an attachment point 34 for the rear of the right side waistband strap 14 and the right side of the rear panel waistband 13 at the intersection with the top of the right leg band 32 at the upper right corner of the rear panel 22.

There is an attachment point 30 of the front panel left fastener device 19 affixed to the left side of front panel waistband 12 at the intersection with the top of the left leg band 33 at the upper left corner of the front panel 20. There is an attachment point 29 of the front panel right fastener device 18 affixed to the right side of the front panel waistband 12 at the intersection with the top of the right leg band 32 at the upper right corner of the front panel 20.

As illustrated in FIG. 2, the undergarment 10 is completed in situ by fastening together the right side waistband strap fastener device 16 and the mating front panel right fastener device 18 at the attachment point 29, and by fastening together the left side waistband strap fastener device 17 and the mating front panel left fastener device 19 at the attachment point 30. In the closed state, the undergarment 10 is formed into a continuous and unified undergarment 10.

FIG. 3 is a schematic front view of the undergarment 10 shown with the waistband fastener devices 16 and 17 at the front of the side straps at the waistband 14 and 15 disconnected from the mating front panel fastener devices 18 and 19.

FIG. 4 is a top-down inside schematic view of undergarment 10 shown in its flat, disconnected, and fully extended open state. The crotch panel liner 31 is permanently attached to the inside of the undergarment 10 between the front panel 20 and the rear panel 22, directly above the inside of the crotch panel 21.

Figure 5:
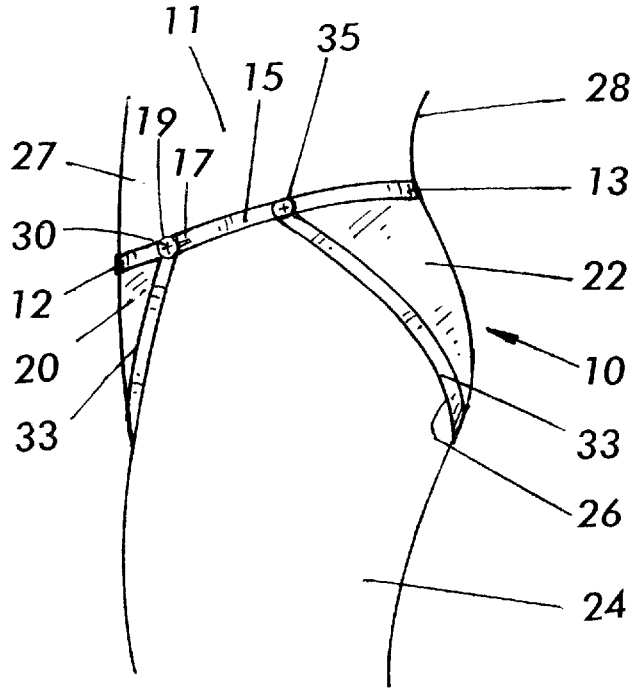
FIG. 5 is a left side view of the undergarment being worn.

FIG. 5 is a left side view of the undergarment 10 in its closed state as a unified assembly, which fits below the lower front 27 and lower rear 28 of the wearer.

Figure 6:
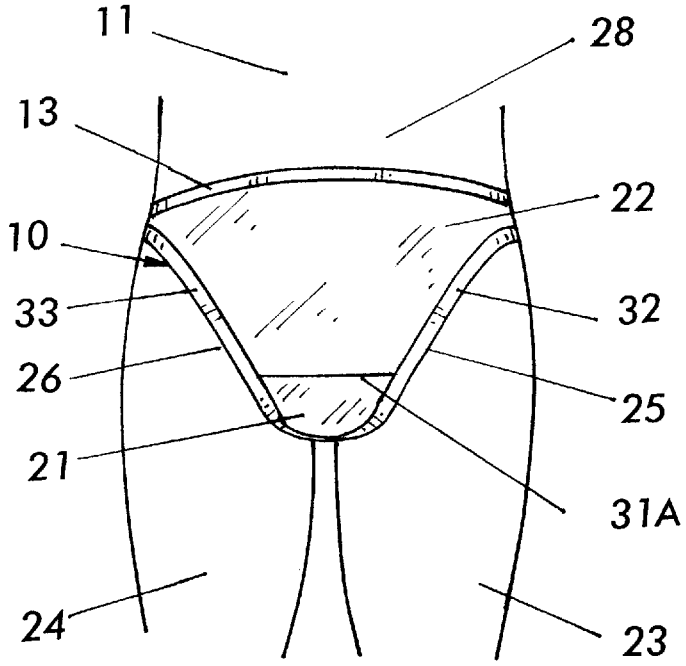
FIG. 6 is a rear view thereof.

FIG. 6 is a rear view of the undergarment 10 which fits below the area of the rear lower back 28 of the wearer 11 outside seam 31A is shown connecting crotch panel 21 to rear panel 22.

Figure 7:
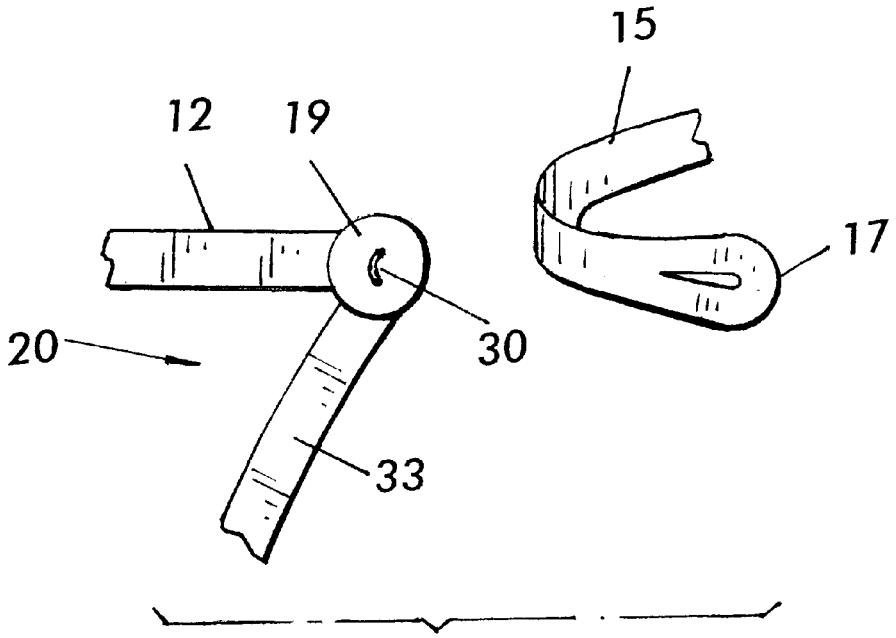
FIG. 7 is a close-up view of the left side waistband fastener device and the mating front panel left fastener device of the fastener device in FIG. 1 in their disconnected open state.

FIG. 7 is a close-up view of the left side waistband fastener device 17 at the front of left side waistband straps 15 and the mating front panel left fastener device 19 at the top left corner of the front panel 20, shown in their disconnected state. FIG. 7 shows the front panel waistband 12, the front panel 20, the left leg band 33, the left side waistband 15, and the attachment point 30 of front panel left fastener device 19 affixed to the left side of the front panel waistband 12 at the intersection with the top of the left leg band 33.

Figure 7A:
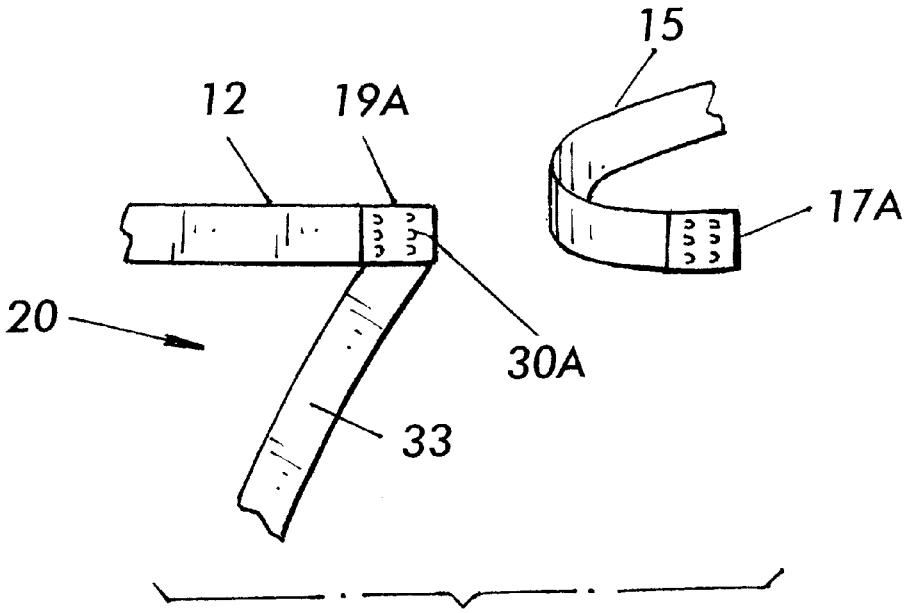

FIG. 7A shows a first alternative left side waistband fastener device 17A at the front of left side waistband 15 and a mating first alternative front panel left fastener device 19A at an attachment point 30A with hook and loop or VELCRO® or VELCRO®-type fastener devices.

Figure 7B:
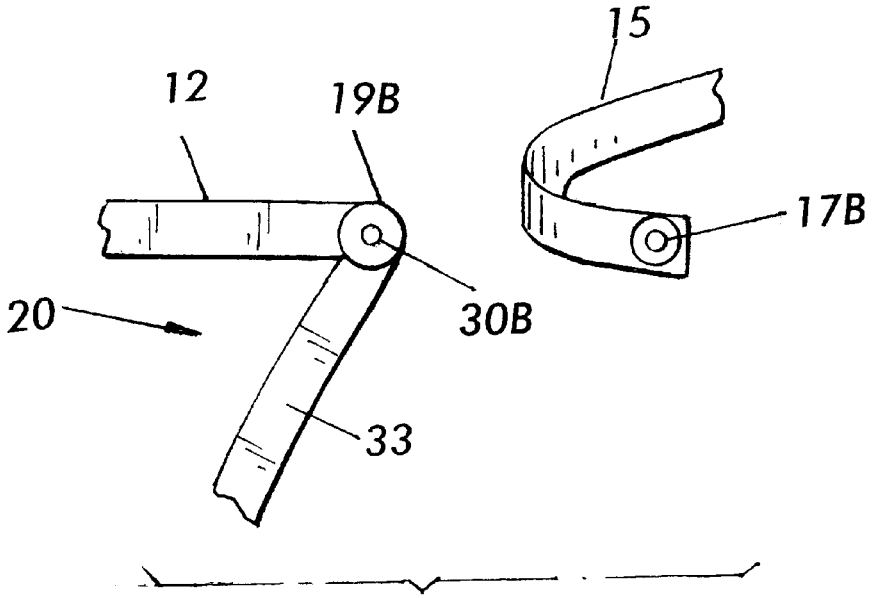

FIG. 7B shows a second alternative left side waistband fastener device 17B at the front of left side waistband strap 15 and a mating second alternative front panel left fastener device 19B at an attachment point 30B with snap fastener devices.

Figure 7C:
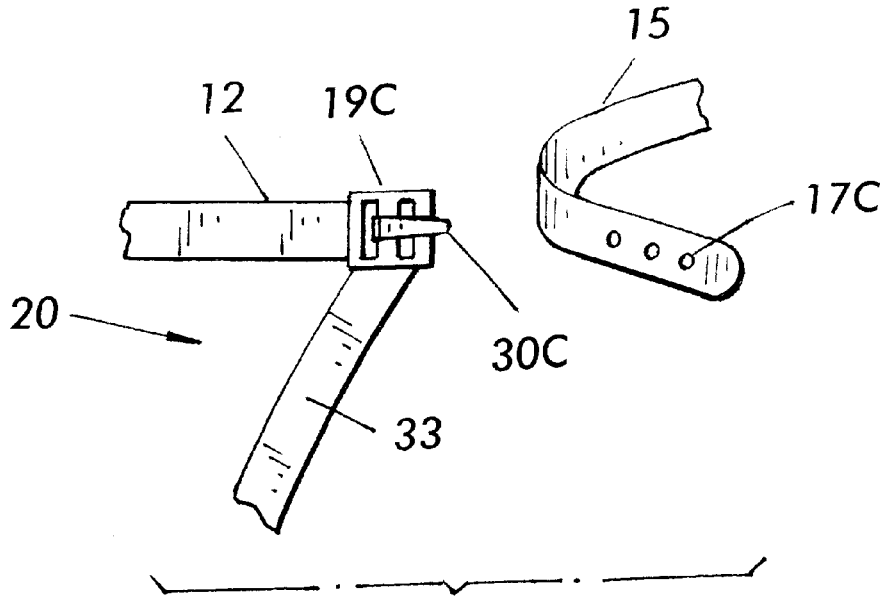

FIG. 7C shows a third alternative left side waistband fastener device 17C at the front of left side waistband strap 15 and a mating third alternative front panel left fastener device 19C at an attachment point 30C with a belt and buckle fastening device.

Figure 7D:
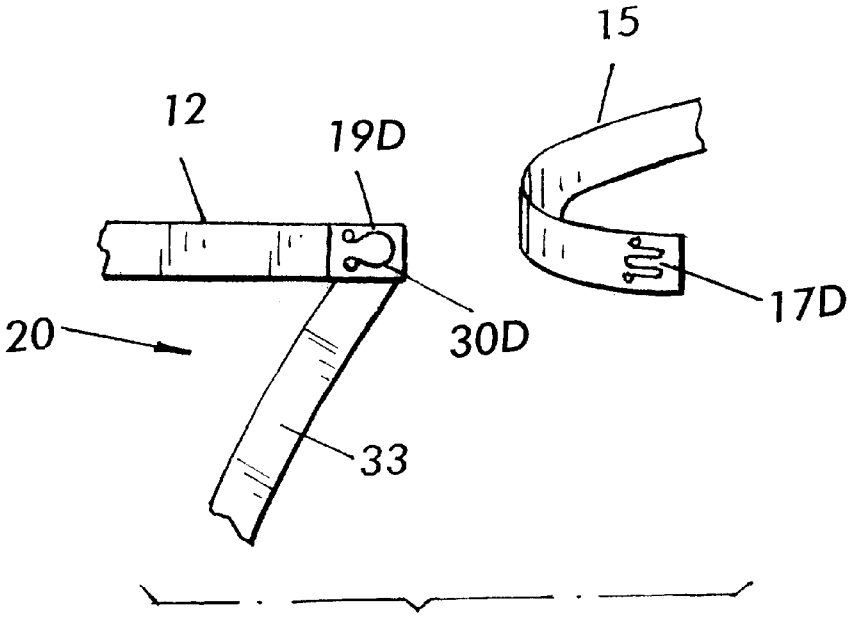

FIG. 7D shows a fourth alternative left side waistband fastener device 17D at the front of left side waistband strap 15 and a mating fourth alternative front panel left fastener device 19D at an attachment point 30D which is a hook and eye fastener device.

Figure 7E:
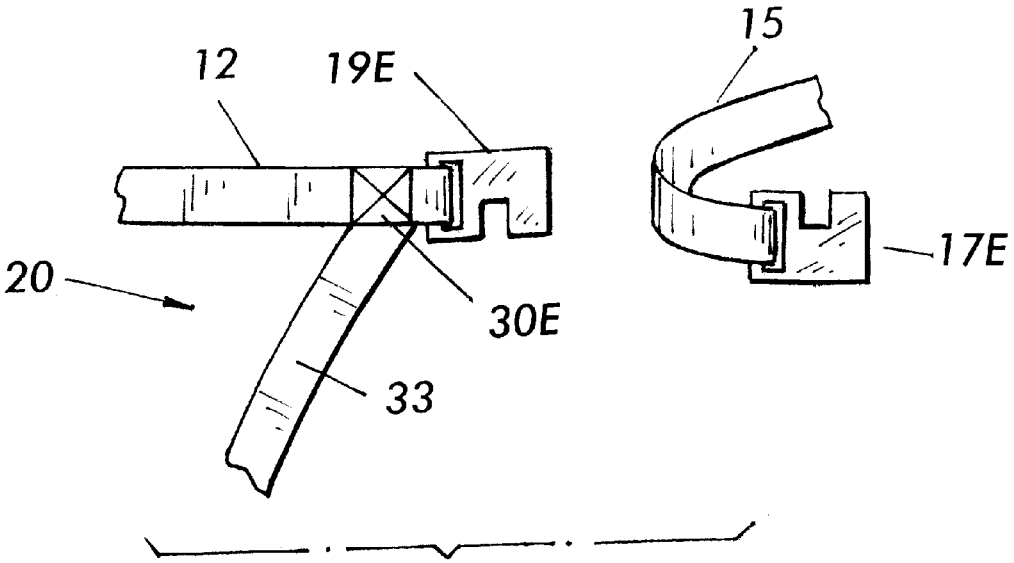

FIG. 7E shows a fifth alternative left side waistband fastener device 17E at the front of left side waistband strap 15 and a mating fifth alternative front panel left fastener device 19E at an attachment point 30E, in the form of an interlocking clasp fastener device.

Figure 7F:
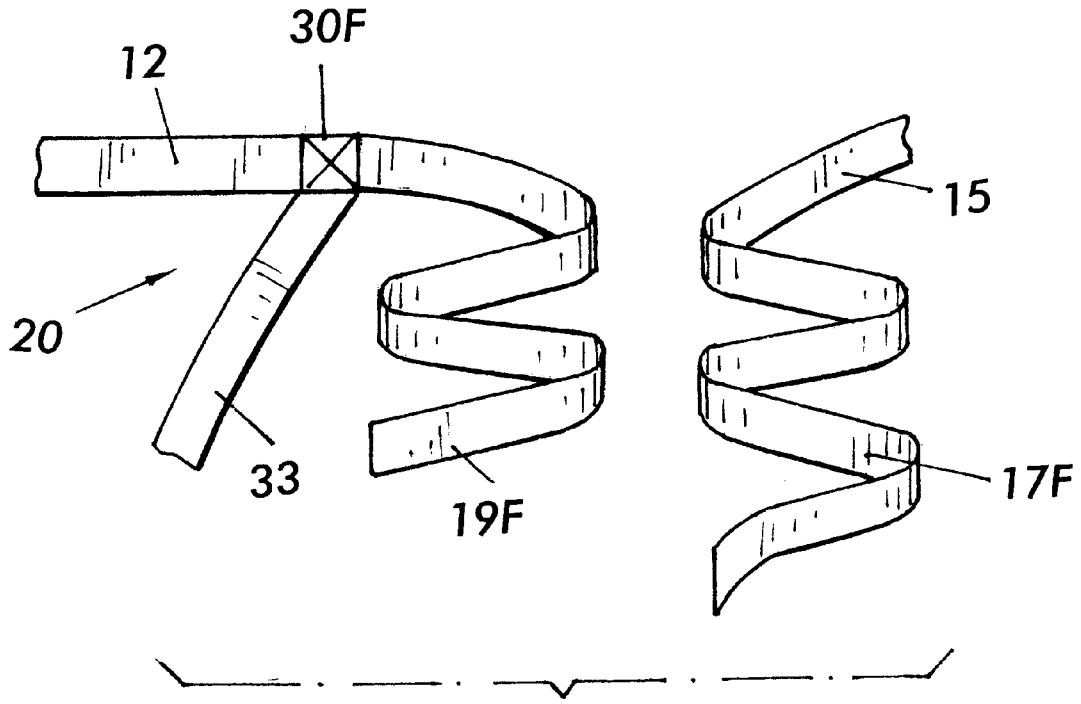

FIG. 7F shows a sixth alternative left side waistband fastener device 17F at the front of left side waistband strap 15 and a mating sixth alternative front panel left fastener device 19F at an attachment point 30F using tie fastener devices, which are tied to connect them.

Figure 7G:
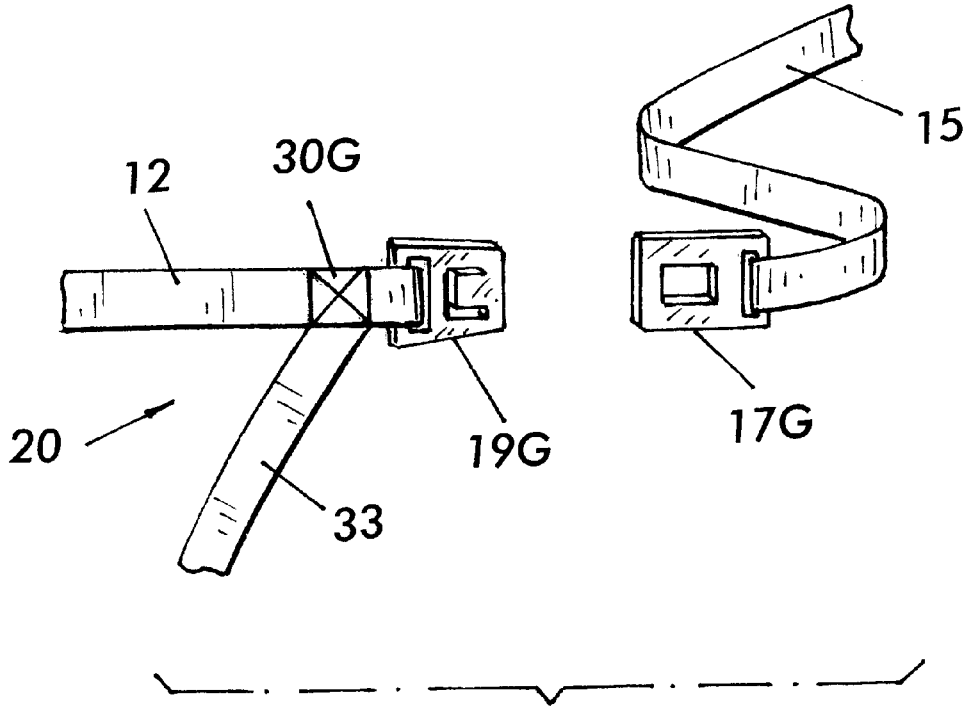

FIG. 7G shows a seventh left side waistband fastener device 17G at the front of left side waistband strap 15 and a mating seventh alternative front panel left fastener device 19G at an attachment point 30G as a snap together and apart slide fastener device.

The quick release and refastenable undergarment 10 enables a wearer 11 to quickly release the connected undergarment 10 from its closed state (as shown in FIGS. 1, 2, 5, and 6) by disconnecting the right side waistband fastener device 16 from the mating front panel right fastener device 18 and/or by disconnecting the left side waistband fastener device 17 from the "mating" front panel left fastener device 19 and to refasten the disconnected undergarment 10 by connecting the right side waistband fastener device 16 by pulling it forward towards the "mating" front panel right fastener device 18 and/or by connecting the left side waistband fastener device 17 by pulling it forward towards the "mating" front panel left fastener device 19. The initial connection or the quick release disconnection, may be performed on the right or left sides, individually or simultaneously. The garment may be assembled on or off the body.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An undergarment comprising:

at least one panel including a front panel having a front top edge and extending down a front of a wearer's body from the front top edge, the front panel extending to a crotch of the body; a rear panel having a rear top edge and extending down a rear of the wearer's body from the rear top edge to the crotch, wherein at least one of the front and rear top edges is elastic over its length and the at least one panel is shaped so that it has left and right upper corners with respect to the left and right sides of the body at both the front and the rear top edges, and the front and rear panels being sized and shaped such that when the undergarment is worn on the body, there is space between the front and rear top edges and between the left corners at the front and rear panels and between the right corners at the front and rear panels and along the sides of the body;

a left and a right flexible strap respectively fastened to the rear panel at the top rear edge at the left and right upper corners of the rear panel; each strap having a free end with a respective first fastening element thereon;

a respective second cooperating fastening element at the front top edge of the front panel at the left and right upper corners of the front panel for cooperating with the respective first fastening elements so that the strap at each side of the body extends from the rear panel and may be fastened to the front panel for completing the formation of the undergarment, the cooperating first and second fastening elements being adapted to be fastened together, and separated and refastened.

2. The undergarment of claim 1, wherein the at least one panel comprises a separate front panel at the front of the body, a separate rear panel at the rear of the body with the front and the rear panels being joined to pass below the crotch.

3. The undergarment of claim 2, further comprising a separate crotch panel at the crotch between the front and the rear panels.

4. The undergarment of claim 2, wherein the front panel front top edge has a first waistband, the rear panel rear top edge has a second waistband, the straps attached at both sides of the rear panel are attached at the second waistband, and the second fastening devices on the front panel are at the first waistband.

5. The undergarment of claim 1, wherein the first fastening device on the strap and the second fastening device on the front panel are respective hook and loop type fasteners.

6. The undergarment of claim 1, wherein the first fastening device on the strap and the second fastening device on the front panel are respective snap fasteners.

7. The undergarment of claim 1, wherein one of the first and second fastening devices is a belt and the other of the first and second fastening devices is a buckle which cooperates with the belt for connecting the front and rear panels.

8. The undergarment of claim 1, wherein one of the first and second fasteners is a hook and the other of the first and second fastening devices is an eye, and the hook and eye cooperate for connecting the front and rear panels.

9. The undergarment of claim 1, wherein the first fastening device on the strap and the second fastening device on the front panel are respective interlocking clasp fasteners.

10. The undergarment of claim 1, wherein the first fastening device on the strap and the second fastening device on the front panel are respective bow and tie fasteners.

11. The undergarment of claim 1, wherein the first fastening device on the strap and the second fastening device on the front panel are respective cooperating slide fasteners.

12. An undergarment comprising:

at least one panel including a front panel having a front top edge and extending down a front of a wearer's body from the front top edge, the front panel extending to a crotch of the body; a rear panel having a rear top edge and extending down a rear of the wearer's body from the rear top edge to the crotch, wherein the at least one panel is shaped so that it has left and right upper corners with respect to the left and right sides of the body at both the front and the rear top edges, side edges of the at least one panel extending from the left and right upper corners toward the crotch and at least one side edge being elastic over its length, and the front and rear panels being sized and shaped such that when the undergarment is worn on the body, there is space between the front and rear top edges and between the left corners at the front and rear panels and between the right corners at the front and rear panels and along the sides of the body;

a left and a right flexible strap respectively fastened to the rear panel at the top rear edge at the left and right upper corners of the rear panel; each strap having a free end with a respective first fastening element thereon;

a respective second cooperating fastening element at the front top edge of the front panel at the left and right upper corners of the front panel for cooperating with the respective first fastening elements so that the strap at each side of the body extends from the rear panel and may be fastened to the front panel for completing the formation of the undergarment, the cooperating first and second fastening elements being adapted to be fastened together, and separated and refastened.

13. An undergarment comprising:

at least one panel including a front panel having a front top edge and extending down a front of a wearer's body from the front top edge, the front panel extending to a crotch of the body; a rear panel having a rear top edge and extending down a rear of the wearer's body from the rear top edge to the crotch, wherein the at least one panel is shaped so that it has left and right upper corners with respect to the left and right sides of the body at both the front and the rear top edges, and the front and rear panels being sized and shaped such that when the undergarment is worn on the body, there is space between the front and rear top edges and between the left corners at the front and rear panels and between the right corners at the front and rear panels and along the sides of the body;

a left and a right flexible strap respectively fastened to the rear panel at the top rear edge at the left and right upper corners of the rear panel; each strap having a free end with a respective first fastening element thereon and at least one strap being elastic over its length;

a respective second cooperating fastening element at the front top edge of the front panel at the left and right upper corners of the front panel for cooperating with the respective first fastening elements so that the strap at each side of the body extends from the rear panel and may be fastened to the front panel for completing the formation of the undergarment, the cooperating first and second fastening elements being adapted to be fastened together, and separated and refastened.

* * * * *